US011062570B2

(12) United States Patent
Lin

(10) Patent No.: US 11,062,570 B2
(45) Date of Patent: Jul. 13, 2021

(54) METHOD, SYSTEM, AND APPARATUS FOR ADMINISTERING TABLE GAMES TO REAL AND VIRTUAL USERS SIMULTANEOUSLY

(71) Applicant: CASINOTABLE INC., Henderson, NV (US)

(72) Inventor: Wen Hao Lin, Henderson, NV (US)

(73) Assignee: CASINOTABLE GROUP INC., Dover, DE (US)

( * ) Notice: Subject to any disclaimer, the term of this patent is extended or adjusted under 35 U.S.C. 154(b) by 129 days.

(21) Appl. No.: 16/190,133

(22) Filed: Nov. 13, 2018

(65) Prior Publication Data

US 2019/0147705 A1 May 16, 2019

Related U.S. Application Data

(60) Provisional application No. 62/584,786, filed on Nov. 11, 2017.

(51) Int. Cl.
*G07F 17/32* (2006.01)

(52) U.S. Cl.
CPC ..... *G07F 17/3293* (2013.01); *G07F 17/3209* (2013.01); *G07F 17/3211* (2013.01)

(58) Field of Classification Search
CPC ..... G07F 17/3293
See application file for complete search history.

(56) References Cited

U.S. PATENT DOCUMENTS 5,781,647 A 7/1998 Fishbine et al.
7,480,870 B2 1/2009 Anzures et al.
7,812,826 B2 10/2010 Ording et al.
8,152,641 B2 * 4/2012 Hill ..... G07F 17/32 463/40
9,959,701 B2 * 5/2018 Andres ..... G07F 17/3267
10,078,939 B2 9/2018 Frenkel et al.
10,223,862 B2 * 3/2019 Nordahl ..... G07F 17/322
2003/0232651 A1 * 12/2003 Huard ..... G07F 17/3244 463/42
2006/0128455 A1 6/2006 Bourbour et al.
2007/0060259 A1 * 3/2007 Pececnik ..... G07F 17/3288 463/16
2007/0178955 A1 * 8/2007 Mills ..... G07F 17/32 463/13
2008/0026807 A1 * 1/2008 Moshal ..... G07F 17/3293 463/16
2008/0032798 A1 * 2/2008 Hatamian ..... G07F 17/32 463/42

(Continued)

FOREIGN PATENT DOCUMENTS

EP 2 518 705 10/2012

OTHER PUBLICATIONS

Paulo Martins et al., "Poker Vision: Playing Cards and Chips Identification based on Image Processing", PokerVision: Perception layer for a Poker Game, 2011, pp. 1-8.

*Primary Examiner* — Jay Trent Liddle
(74) *Attorney, Agent, or Firm* — Kile Park Reed & Houtteman PLLC

(57) ABSTRACT

A system, including a tablet gaming table, allows casino dealers to connect with players both in-person and in Virtual Reality (VR). This system can be used for popular casino games such as blackjack or baccarat, and can also serve as a tool for casinos to increase player traffic while maximizing dealer employee efficiency.

1 Claim, 7 Drawing Sheets

(56) References Cited

U.S. PATENT DOCUMENTS

| | | | | |
|---|---|---|---|---|
| 2008/0070659 | A1* | 3/2008 | Naicker | G07F 17/32 463/12 |
| 2008/0220836 | A1* | 9/2008 | Nagano | G07F 17/32 463/12 |
| 2009/0291762 | A1* | 11/2009 | Walker | G07F 17/3241 463/42 |
| 2010/0102511 | A1* | 4/2010 | Tammesoo | G07F 17/32 273/292 |
| 2011/0079959 | A1* | 4/2011 | Hartley | G07F 17/3223 273/292 |
| 2011/0275432 | A1* | 11/2011 | Lutnick | G07F 17/3244 463/25 |
| 2012/0252564 | A1* | 10/2012 | Moore | A63F 3/00157 463/25 |
| 2013/0083066 | A1* | 4/2013 | Aoki | H04M 1/72544 345/633 |
| 2013/0165215 | A1* | 6/2013 | Arezina | G07F 17/3211 463/25 |
| 2013/0344937 | A1* | 12/2013 | Kuhn | G07F 17/3211 463/20 |
| 2014/0011561 | A1* | 1/2014 | Lutnick | G07F 17/3218 463/17 |
| 2014/0357361 | A1* | 12/2014 | Rajaraman | G07F 17/323 463/31 |
| 2015/0024818 | A1* | 1/2015 | Chun | G07F 17/3209 463/11 |
| 2015/0215581 | A1* | 7/2015 | Barzuza | G06F 3/04842 348/14.1 |
| 2017/0154489 | A1* | 6/2017 | Chun | G07F 17/3272 |
| 2017/0157507 | A1* | 6/2017 | Aoki | G06K 9/00671 |
| 2018/0084197 | A1* | 3/2018 | Lee | H04N 5/23238 |
| 2019/0362594 | A1* | 11/2019 | Shigeta | G07F 17/3293 |

* cited by examiner

METHOD, SYSTEM, AND APPARATUS FOR ADMINISTERING TABLE GAMES TO REAL AND VIRTUAL USERS SIMULTANEOUSLY

CROSS-REFERENCE TO RELATED APPLICATION

The present nonprovisional application claims the benefit of U.S. Provisional Application No. 62/584,786 filed on Nov. 11, 2017 and incorporates the same by reference.

BACKGROUND OF THE INVENTION

Field of the Invention

The present invention relates to a method, system, and apparatus for administering table games to real and virtual users simultaneously.

Related Art

Currently there are two major gaming table solutions in the casino industry. One option is the traditional gaming table, which can only administer one type of casino game depending on the permanent design of the tabletop; typically, this kind of tabletop is variations of foam padding material. The more modern option includes a number of electronic table products in the market attempting to adapt to a declining industry.

Traditional gaming tables make sense during peak seasons, when tables are filled while casinos are generating significant customer traffic. During slow seasons, dealer employees' work efficiency decreases due to long idle time when no LIVE player is present. The designs on traditional gaming tables are permanently marked on top of the foam padding material, making these tables one-dimensional and not versatile. With the tabletop material, spilled drinks or food residues are difficult to clean.

Newer electronic gaming options are all convenient in their own ways, but almost all fail to solve the problem of casino efficiency: in fact, most existing electronic options only accomplish one immediate short-term goal of cutting labor cost—eliminating dealer employees—which isn't necessarily the best solution for maximizing casino revenue.

Various attempts have been made in the related art. The following references, all of which are hereby incorporated by reference, discuss technologies that may be utilized in the field of table games:

U.S. Pat. No. 7,812,826 B2 to Ording, et al. relates to a portable communication device with multi-touch input that detects one or more multi-touch contacts and motions and performs one or more operations on an object based on the one or more multi-touch contacts and/or motions.

U.S. Patent Application Publication No. 2006/0128455 A1 to Bourbour, et al. relates to an apparatus supporting the play of a casino table card game comprising: a playing surface; a card-delivery device; a microprocessor operatively connected to the card-delivery device; player controlled election identifiers that provide a visible signal of an election; at least two areas for display of at least partial card hands from which only one card hand may be elected for a wagering game by a player; the card-delivery device having at least one sensor thereon for sensing the presence of cards in a delivery area of the card-delivery device from which cards may be removed; the at least one sensor on the card-delivery device providing a signal to the microprocessor that a sensed set of cards has been removed from the delivery area; and in response to the signal, the microprocessor preventing players from entering a new election.

U.S. Pat. No. 5,781,647 A to Fishbine, et al. relates to a computer implemented gambling chip recognition system having the ability to capture an image of a stack of gambling chips and automatically processing the image to determine the number of chips within the stack and the value of each.

Martins P., Reis L. P., Teófilo L. (2011) *Poker Vision: Playing Cards and Chips Identification Based on Image Processing* relates to an approach to the identification of playing cards and counting of chips in a poker game environment, using an entry-level webcam and computer vision methodologies.

European Patent Application No. EP 2 518 705 A1 to Grauzer, et al. relates to a security system for a casino table card game has a casino table with: i) indicia thereon for the placement of wagers, ii) a data entry system with the system an associated computer, and iii) sensors that can detect the placement of at least one specific category of wager; a shuffling device with a microprocessor integral to the shuffler for providing information from the shuffler in real time, receives information from the sensors, and receives information from the data entry system, the associated computer, the microprocessor and the central table gaming computer communicating data among each other in real time.

U.S. Pat. No. 7,480,870 B2 to Anzures, et al. relates to a graphical user interface in an electronic device includes one or more user-interface objects associated with a second user-interface state.

U.S. Pat. No. 10,078,939 B2 to Frenkel, et al. relates to a system for interactive gaming among a plurality of players including a host computer system and a plurality of player terminals communicably coupled to the host computer system or gaming platform via a network and makes provision for virtual players.

None of the aforementioned references however teaches or suggests administering table games to both real and virtual players at the same time. Furthermore, no attempts have been made to accommodate both LIVE and VR players simultaneously.

SUMMARY OF THE INVENTION

The following presents a simplified summary in order to provide a basic understanding of some aspects described herein. This summary is not an extensive overview of the claimed subject matter. It is intended to neither identify key or critical elements of the claimed subject matter nor delineate the scope thereof. Its sole purpose is to present some concepts in a simplified form as a prelude to the more detailed description that is presented later.

In one embodiment, there is provided a multi-player gaming system for operating a game involving a live dealer, at least one live player and at least one virtual reality player, the multi-player gaming system comprising: (a) a physical gaming table; (b) a plurality of physical objects for playing the game; (c) a processor or processors; (d) a gaming platform to host the game for the at least one virtual reality player; (e) a player terminal communicably coupled to the gaming platform via a network; (f) a sensor or sensors for conveying a view of the dealer and the physical objects via the network to the player terminal from a perspective of someone seated or standing at the gaming table; and (g) a display at the gaming table to receive and display inputs into the game from the virtual reality player.

In another embodiment, the physical objects include a plurality of chips, and the system further comprises a chip tray and a chip tray camera configured to capture an image of the plurality of chips placed in the chip tray.

In still another embodiment, the physical objects include a plurality of cards, and the system further comprises a card scanner configured to allow the dealer to scan a physical card to be distributed to the at least one virtual player.

In a preferred embodiment, the gaming platform comprises: (a) at least one processor, (b) memory, (c) at least one program, wherein the at least one program is stored in the memory and configured to be executed by the at least one process, the at least one program comprising instructions for: scanning by the card scanner a physical card to be distributed to a virtual player to generate a digital card associated with the virtual player corresponding to the physical card; transmitting the digital card to a terminal device of the virtual player via a network; and receiving a user input from the terminal device via the network.

Preferably, the at least one program of the gaming platform further comprises instructions for: displaying digital cards at a card area of the virtual player on the tablet table based on the user input received from the terminal device via the network.

In another preferred embodiment, the at least one program of the gaming platform further comprises instructions for: capturing by the at least one camera at least one chip placed in a chip area of a real player on the tablet table; determining a number and a value of the at least one chip; and displaying the value of the at least one chip in the chip area of a live player on the terminal device of the virtual user.

In some embodiments, the at least one program of the gaming platform further comprises instructions for: displaying digital chips at a chip area of the virtual player on the tablet table based on the user input received from the terminal device via the network; capturing by the at least one camera at least one card of a live player placed on a card area of the real player on the tablet table; isolating the at least one card of the live player into one or more individual cards; extracting and determining a rank of the one or more individual cards; extracting and determining a suit of the one or more individual cards; generate at least one digital card corresponding to the at least one card of the live player, and transmitting the at least one digital card of the real player to the terminal device of the virtual player via the network.

In another embodiment, each of the at least one camera is an omnidirectional camera.

In one embodiment, there is provided a multi-player gaming system for operating a game involving a live dealer, at least one live player and at least one virtual player, the multi-player gaming system comprising: a tablet table, the tablet table comprising: a display; an arm rest surrounding the display; and at least one camera placed on the arm rest at each of a plurality of player seating areas of the tablet table.

Preferably, the tablet table further comprises a chip tray placed in front of a dealer seating area of the tablet table; a chip tray camera placed on a side of the chip tray, wherein the chip tray camera is configured to capture an image of chips placed in the chip tray; and a card scanner in front of the dealer seating area of the tablet table.

In another embodiment, the at least one camera captures images at a height of a person virtually sitting at a seating area near the table.

In yet another embodiment, each of the at least one camera is an omnidirectional camera.

In still another embodiment, the each of at least one camera comprises an infrared camera for detecting body heat of a live player seating near the infrared camera.

In a preferred embodiment, the system further comprises at least one processor, memory, and at least one program, wherein the at least one program is stored in the memory and configured to be executed by the at least one process, the at least one program comprising instructions for: capturing by the at least one camera at least one chip placed in a chip area of a real player on the tablet table; determining a number and a value of the at least one chip; displaying the value of the at least one chip in the chip area of a live player on the terminal device of the virtual user; capturing by the at least one camera at least one card of a live player placed on a card area of the real player on the tablet table; isolating the at least one card of the live player into one or more individual cards; extracting and determining a rank of the one or more individual cards; and extracting and determining a suit of the one or more individual cards.

BRIEF DESCRIPTION THE DRAWINGS

Non-limiting and non-exhaustive examples are described with reference to the following Figures.

DETAILED DESCRIPTION OF THE INVENTION

Figure 1:
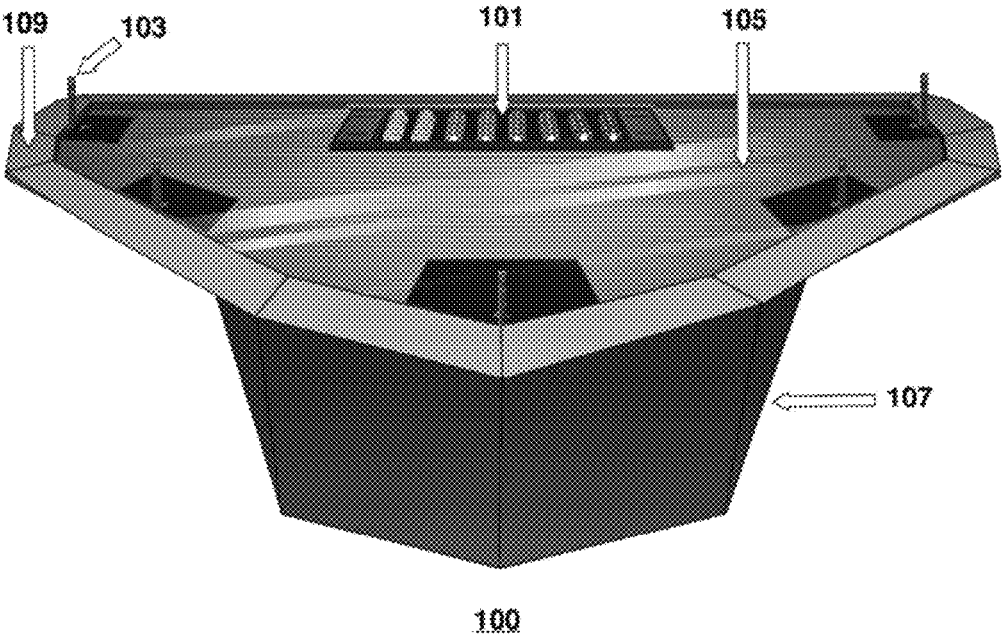
FIG. 1 illustrates an exemplary tablet table according to one embodiment of the present disclosure.

In the following detailed description, references are made to the accompanying drawings that form a part hereof, and in which are shown by way of illustrations specific embodiments or examples. These aspects may be combined, other aspects may be utilized, and structural changes may be made without departing from the present disclosure. Embodiments may be practiced as methods, systems or devices. Accordingly, embodiments may take the form of a hardware implementation, an entirely software implementation, or an implementation combining software and hardware aspects. The following detailed description is therefore not to be taken in a limiting sense, and the scope of the present disclosure is defined by the appended claims and their equivalents.

As used herein, the term "physical" as applied, for example, to a physical table or physical object, such as playing cards or chips, refers to a tangible, and not a virtual or electronic objects.

As used herein, the term "tablet table" refers to a physical or tangible table.

As used herein, the term "module" refers to a part of software, hardware, or a combination thereof that performs a function.

The present invention relates to a method, system, and apparatus for administering table games to real and virtual users simultaneously. The system may comprise a tablet table, which allows casino dealers to connect with players both in-person and in Virtual Reality (VR). This tablet table can be used as a physical gaming table for popular casino games such as blackjack or baccarat, and also serve as a tool for casinos to increase player traffic while maximizing dealer employee efficiency.

The tablet table allows gaming experiences in both reality and Virtual Reality (VR) to coexist. The tablet table serves as a physical table space providing surface area to administer the game, display instructions on the game administered, indicate positions for players to wager bets, etc.

A system for administering table games according to one embodiment allows VR players to access live table games remotely through terminal devices such as gaming consoles, mobile tablets, personal computers, and potentially more options. In this case, the tablet table serves as a channel for online players to access and fill in available positions of LIVE games in regulated casinos. In one embodiment, a VR player has direct view of the dealer and also cards dealt to the VR player; additionally, the VR player's wagering decision is then displayed on the table tablet for the dealer and real players physically present at the tablet table to see.

In addition to the tablet display functionalities and its ability to reach VR players online, it legitimizes the online transactions since VR players are dealing directly with regulated casinos as opposed to less credible options in the world today. In addition, the present disclosure is useful because its fundamental intention is to maintain or even increase workforce by increasing card dealers' work efficiency; additionally, the present disclosure would allow any regulated casinos to administer their own games, accept different forms of currencies, and much more in customizable manners.

Referring to FIG. 1, there is seen an exemplary tablet table 100 according to one embodiment of the present disclosure. The tablet table 100 may comprise a card scanner 101, a camera 103, a display 105, a support 107, and a table rail 109. A dealer may scan physical cards to be distributed to a virtual player with the card scanner 101 to generate digital cards corresponding to the scanned physical cards. The generated digital cards are then associated with the virtual player, who is virtually occupying a first seating area near the tablet table. The camera 103 may be located at the table rail 109 near each of seating areas for users as shown in FIG. 1. The camera 103 may be a commercially available camera. In one embodiment, the camera 103 is an omnidirectional camera. The camera 103 may produce a live stream of images for virtual users, who can see the tablet table and objects around the camera in real-time using his or her terminal device, preferably using virtual reality technology. The camera 103 may produce digital images of physical cards and physical chips at a target area near a second seating area of the tablet table. The camera 103 may pick up signals from all parties who are physically present at the tablet table 100, including the dealer, real player(s), and physical objects such as casino playing cards, casino chips, dice, etc. The camera 103 may be a part of the tablet table 100 or may be directly connected to a gaming platform or a server via a network.

Still referring to FIG. 1, at least one processor embedded in the tablet table or in a server connected to the tablet table may analyze the signals generated by the camera 103. For example, the at least on processor may generate digital cards and digital chips corresponding to captured physical cards and physical chips on the tablet table and associate them with a real player sitting near a first target area of the tablet table. The terminal device of the virtual player may display the digital cards and the digital chips of the real player sitting near the first target area of the tablet table. The display 105 may display at a second target area of the tablet table inputs of a virtual player virtually "sitting" neat the second target area of the tablet table. For example, the inputs of the virtual play may include digital cards or digital chips. As an example, when the virtual player chooses to play a 2 of hearts and bet a hundred dollars with his or her terminal device, the display 105 may display at the second target area of the table tablet a digital version of 2 of hearts and digital chips worth a hundred dollars. The display 105 may be an LCD display with touchscreen capabilities. Thus, the dealer may move digital cards or chips from a virtual player for example by touching on an area showing a digital card or a digital chip on the display 105 with her finger and drag her finger to another target area.

Figure 2:
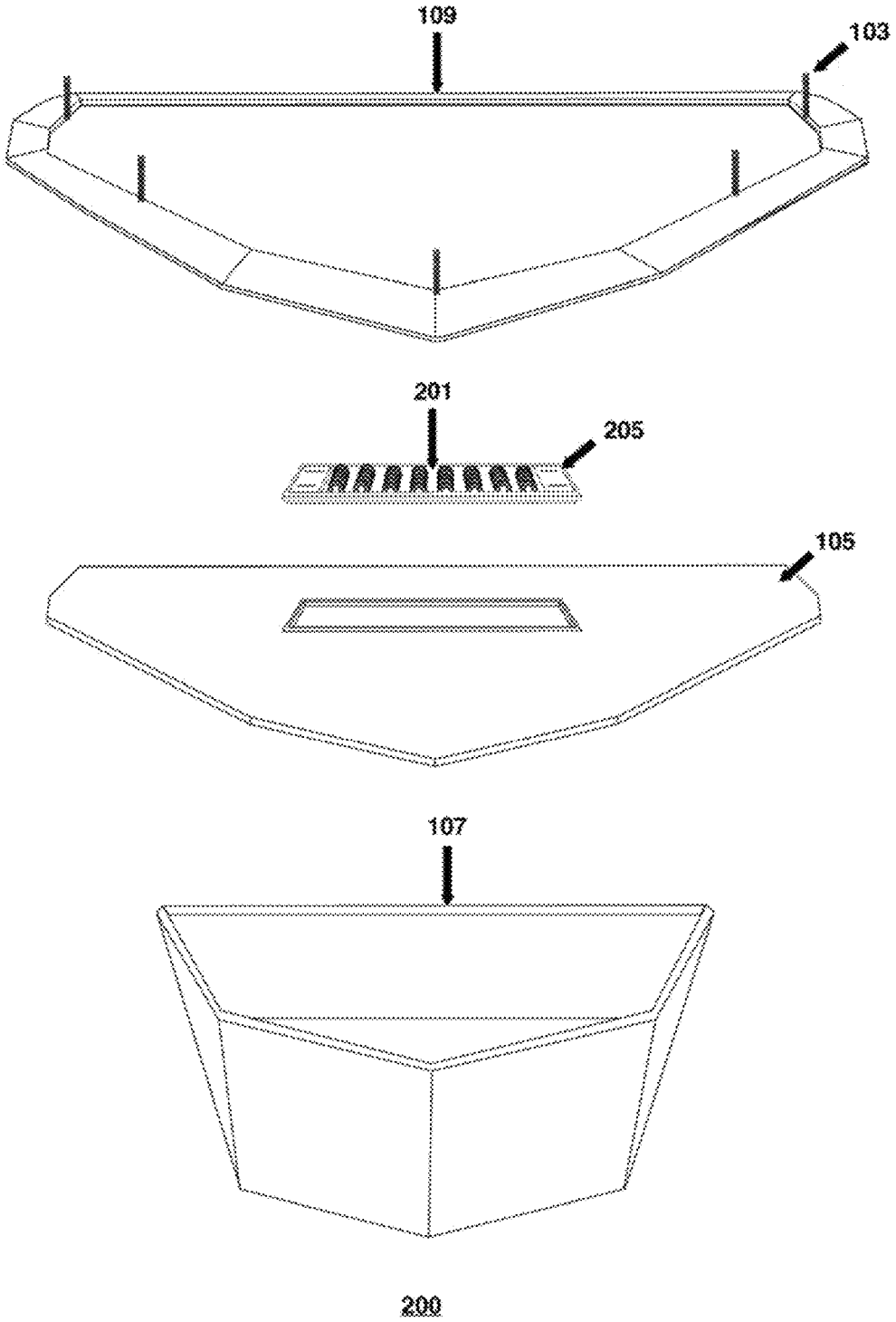
FIG. 2 is an exploded view of an exemplary tablet table according to one embodiment of the present disclosure.

Referring to FIG. 2, there is seen a simplified exploded view of an exemplary tablet table 100 according to one embodiment of the present disclosure. The tablet table 100 may comprise a plurality of cameras 103, a display 105, a table rail 109, a chip tray 201, a chip tray camera 205, and a support 107. The chip tray camera 205 may be implemented on a one side of the chip try 201 to scan chips in the chip tray 201. Images captured by the chip tray camera 205 may be used to determine how many chips of which kind are in the chip tray 205 and the values of the chips using the chip processing module, which will be explained further in the present disclosure. The display 105 comprises at least one processor and memory (not shown). The at least one processor can be any of various commercially available processors. Dual microprocessors and other multi-processor architectures may also be employed as the processor. The memory may include, but is not limited to, RAM, ROM, EEPROM, flash memory or other memory technology, CD-ROM, digital versatile disk (DVD) or other optical disk storage, magnetic cassettes, magnetic tape, magnetic disk storage or other magnetic storage devices, or any other medium which can be used to store the desired information and which can be accessed by a computer. The display 105 may be any one of or combination of liquid crystal display, organic light-emitting diode display, plasma display panel, and/or any commercially available display. Some or all part of the surface of the display 105 may be an interactive touch screen.

Figure 3:
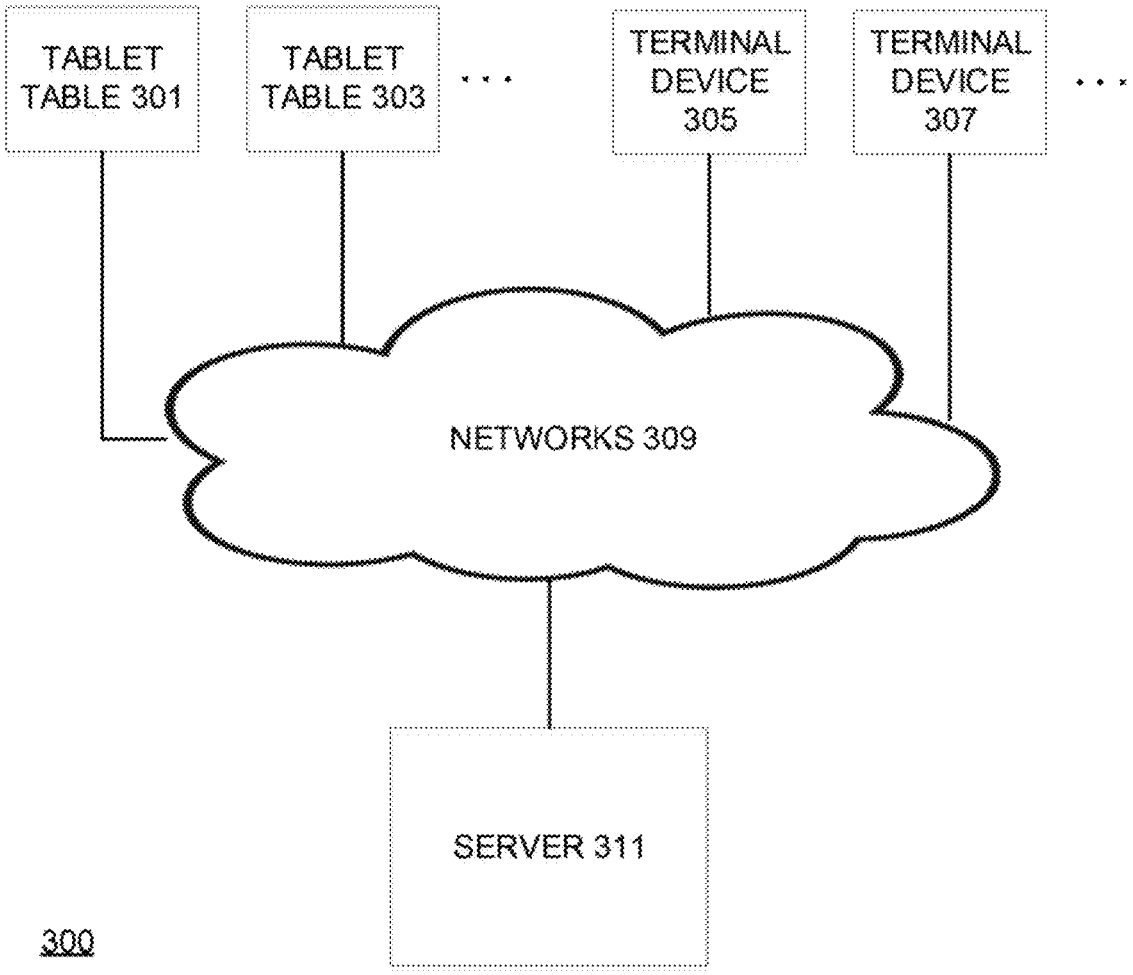
FIG. 3 is a block diagram showing an exemplary system for administering table games to real and virtual players according to one embodiment of the present disclosure.

Referring to FIG. 3, there is seen a block diagram of an exemplary system 300 for administering table games according to one embodiment of the present disclosure. A plurality of tablet tables 301, 303 and a plurality of terminal devices 305, 307 are connected to a server 311 via a network 309. The tablet tables 301, 303 may be the tablet table 100 described above. Real players sitting at one of the table tables 301, 303 may play table games in real-time with virtual players, who are not actually sitting at the tablet tables 301, 303. The virtual players may participate in a table game happening at one of the tablet tables 301, 303 with their terminal devices 305, 307 in real-time. The terminal devices 305, 307 may be, but are not limited to, a personal computer, a laptop, a personal digital assistant, a smartphone, a tablet PC, or the like. The server 311 comprises at least one processor and memory. The server 127 may be a server computer but it is not limited to this; it can be for example a workstation, a router, a personal computer, a portable computer, a microprocessor-based entertainment appliance, a peer device, a cloud server, or any other common network node. One or more servers 311 may be located at each site where tablet tables are placed, or the server 311 may be a cloud server, such as Microsoft® Azure Cloud Server, Amazon Web Services®, or the like. The tablet tables 301, 303 may communicate with the terminal devices 305, 307 directly via the network 309. Preferably, the tablet tables 301 may communicate with the terminal devices 305, 307 only through the server 311. The tablet tables 301, 303 and/or the server 311, separately or in combination, may serve as a gaming platform. Examples of the network 309 include, but are not limited to, the Internet, Local Area Network (LAN), Metropolitan Area Network (MAN), a Wide Area Network (WAN), wireless network (e.g., using Wireless Application Protocol WAP), a secured custom connection, and the like.

In one embodiment, the server 311 is the central processing unit. It handles processing, storage, aggregation, modeling, organization, and delivery of data from the sensors (e.g., the camera 103 and the card scanner 101) of the tablet table 100 and the terminal device 305 a virtual player are using. The sensors of the tablet table 301 are connected to the server 311. The terminal device 305 may be any mobile or web application on any and all compatible electronic devices with software designed to connect to the server 311.

Figure 4:
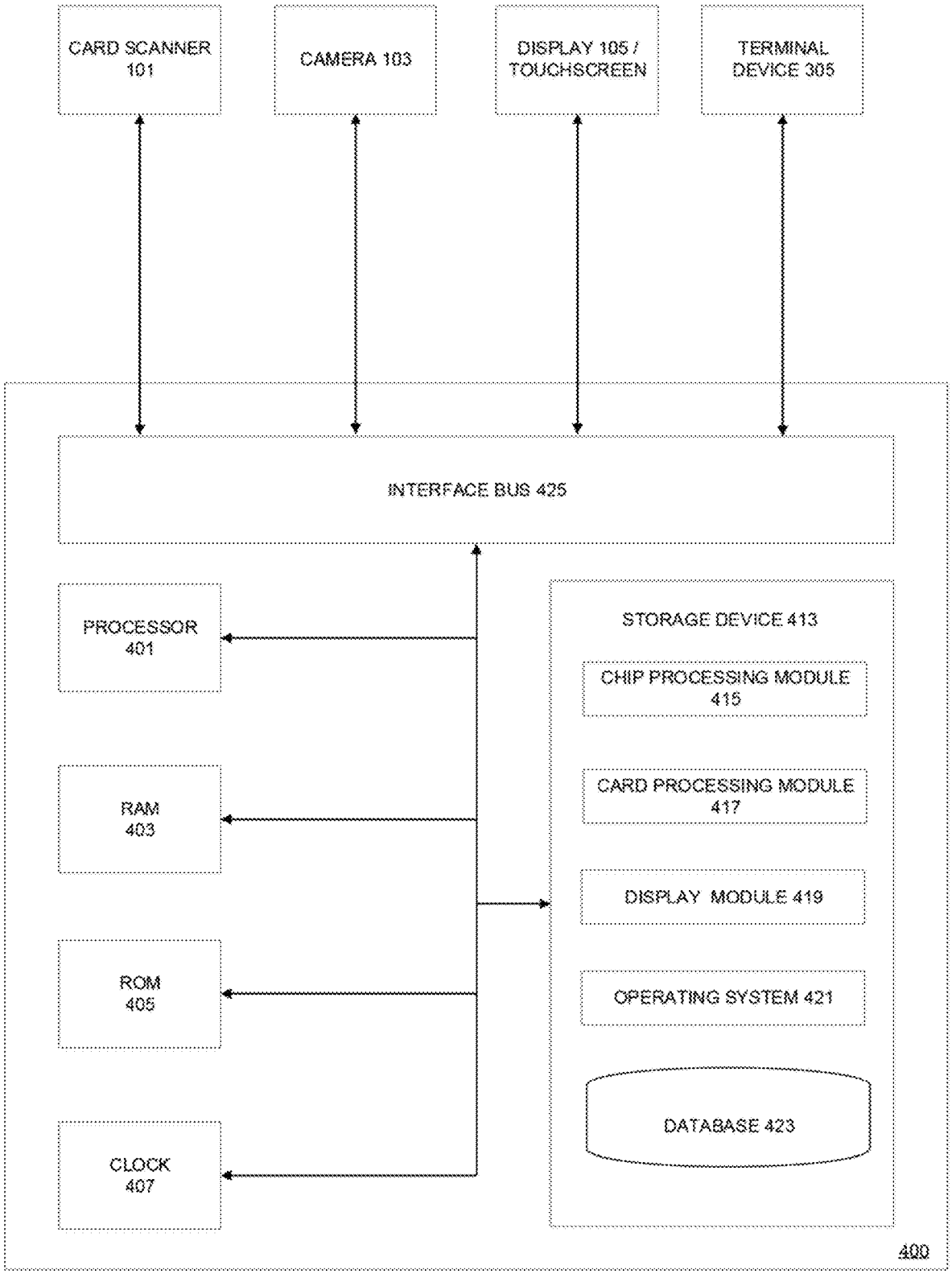
FIG. 4 is a block diagram showing an exemplary system for administering table games to real and virtual players according to one embodiment of the present disclosure.

Referring to FIG. 4, there is seen an exemplary block diagram 400 of the gaming platform 400 according to one embodiment of the present disclosure. The gaming platform 400 may comprise a processor 401 to control table games; a RAM 403; a ROM 405; clock 407; a storage device 413 to house software or computer-executable code that control the interactive games offered by the gaming platform 400; a display module 419 to control graphics displayed on the tablet tables 301 and the terminal devices 305, 307; a chip processing module 415; a card processing module 417; an operating system 421; and the database 423. Examples of such database 423 include DB2, MySQL, Oracle, Sybase, and the like. Alternatively, the database may be implemented using various standard data-structures, such as an array, hash, list, stack, structured text file (e.g., XML), table, and/or the like. Such data-structures may be stored in memory and/or in structured files. A computer board in the table tablet 100 or in the display 105 may comprise a processor 401, a RAM 403, a ROM 405, a clock 407, a storage device 413, and an interface bus 425.

Still referring to FIG. 4, the chip processing module 415 may be configured to determine the number of chips and the value of each chip within a staked pile of one or more chips. In one embodiment, the chip processing module 415 comprises the steps of: (a) imaging the stacked pile of chips using the camera 103; (b) storing said image in the database 423; (c) determining the number of chips within the stacked pile of chips by identifying chip edges for each chip within said image; and (d) determining a chip representation for each chip within the stacked pile of chips by comparing each said chip representation with a plurality of predetermined chip representations wherein each predetermined chip representation defines a casino chip having a specific monetary value.

Still with respect to FIG. 4, the card processing module 417 may be configured to recognize a card or cards on the tablet table 100. In one embodiment, the card processing module 417 comprises the steps of: (a) locating cards on the tablet table 100 on a digital image generated by the camera 103; (b) isolating each one of the cards of the digital image; (c) extracting and identifying the rank of the card; and (d) extracting and identifying the suit of the card.

In one embodiment, the gaming platform 400 may comprise a sensor processing module. The sensor processing module may be configured to process data generated by the various sensors (e.g., the scanner 101 and the camera 103) on the tablet table 100. This module operates on the data generated by the sensor system. The primary function of this module is to combine and convert the large and noisy raw physical data into more easily transferable and analyzable information about that raw data. For example, the sensor processing module may take raw data from a depth sensor and camera and convert it to an estimate of how many chips are on the table.

The gaming platform 400 may comprise a sensor data ingestion service module, which encapsulates communication with the sensor data communication system for the sensor processing module allowing the module to reside in either close physical proximity to the sensor system (within the table on premises at the casino) or to be hosted remotely in a data center.

In one embodiment, the card processing module 417 may be configured to encapsulate logic for processing data from the sensors (e.g., the card scanner 101 and the camera 103) to determine what card the sensors are detecting. For example, the card processing module 417 may be configured to take video feed data from the sensors, apply computer vision techniques to determine what cards are in a player's hand, and return a textual representation of that hand. A digital card may be generated based on the textual representation. The card processing module 417 may be configured to collect data from the sensors to determine the value of the cards that the sensors detect. One or more techniques can be used in the identification of the card value. For example, the card processing module 417 may be configured to take video feed data from cameras and apply computer vision techniques such as pattern matching or reinforced learning algorithms. Other methods can include, but are not limited to, reading RFID (Radio-Frequency Identification) or similar electronic tags embedded in the cards. The result may be a digitized value of each card in each player's hand.

In another embodiment, the chip processing module 415 may be configured to encapsulate logic for processing data from the chip sensors (e.g., the camera 103 and the chip tray camera 205) to determine the count and value of chips in the sensor's processing radius. For example, the chip processing module 415 may be configured to combine video and depth data from the chip sensors to determine how many of each chip a player has bet and returning the value of that bet.

In a preferred embodiment, the gaming platform 400 comprises a player/seat management module. The player/seat management module may be configured to encapsulate logic for processing data from the player sensors to determine if a seat is empty, who is in the seat if it is not empty, and any actions that player is taking while in the seat. The plyer sensors may be the camera 103 or a sensor that is implemented near a seating area. Actions here are defined as both actions pertaining to the game such as placing a bet and actions not pertaining to the game such as ordering a drink. A combination of sensors and techniques can be used to measure player presence and action. For example, the player/seat management module may be configured to combine data from an infrared camera to detect body heat with a traditional camera, feed that into a facial and general object detection reinforcement learning model, and determine the presence of a player. Reinforcement learning models can be further applied to track the movement of a player's hands and body to determine what action a player is taking. For example, these actions may include: (a) Play related; (b) Placing a bet; (c) Passing or checking; (d) Folding a hand; (e) Entering the table; (f) Exiting the table; (g) Requesting More Chips; (h) Splitting; (i) Doubling Down; (j) Hand being dealt; (k) New cards being flipped; (l) New cards being dealt; (m) Non-Play related; (n) Signaling for wait staff; (o) When they last reached for their drink or food; (p) Fill level of their glass; (q) Smoking a cigarette; (r) Speaking to another player or to the dealer; (s) Speaking to a person not at the table; (t) Checking their phone; (u) Checking their watch; (v) Fidgeting/Restlessness.

As an example of how these features may be utilized is now provided with respect to a player who has been sitting and playing at the tablet table 100 for a long period of time. The player's drink is almost empty, as seen from the declining frequency of their arms reaching for it and bringing it to their mouth. This action-specific data is sent to the storage database and processing engine, which triggers an alert from the Alert Calculation Engine. Connecting to the casino's food and beverage system, a server is dispatched with a complimentary drink.

As another example, a player places a bet which is detected by the player sensors, the bet is determined to be large by the chip sensors, the player then folds later in the hand which is detected by the player sensors. The player then checks his or her watch which is also detected by the player sensors. This data is transmitted to the central processing service where it is run through prediction models which determine that the player is likely to exit the table. The central processing unit or the gaming platform 400 can then transmit an alert to the operational dashboard component which would notify wait staff allowing them to give the player a reward or compensation for remaining at the table.

As a further example, a new player enters a table to play blackjack. This is detected by the infrared camera observing human body heat in the seat. It is corroborated by a visible light camera and reinforcement learning model detecting a human face and body where the seat is. The player requests chips from the dealer which is registered by the player handing identification to the dealer and receiving a stack of chips from the dealer. This is corroborated by the dealer camera noticing that the dealer has turned their head to the pit boss and spoken (a step in the process of issuing chips) and then pulled chips from the dealer tray which are given to the player. The player then places a bet. This is registered by a combination of a depth sensor and a traditional camera noticing that the players hand has moved forward into the betting area along with the chip sensors detecting the presence of chips in the betting area. The hand is then dealt In another preferred embodiment, the gaming platform comprises a data aggregation module. The data aggregation module may be configured to manage the output of the card processing module 417, chip processing module 415, and player/seat management module. Management in this context is defined as any combination, aggregation, or post processing that must be applied before data is ready to be communicated outside of the sensor processing module.

In one embodiment, the system for administering table games comprises a processed data communication system, which is configured to handle communication between the sensor processing module and the central processing component. This includes but is not limited to: network management, communication routing, data serialization, and data encryption.

In a preferred embodiment, the gaming platform 400 may be implemented in distributed computing environments, where tasks or modules are performed by remote processing devices, which are linked through a communications network, such as a Local Area Network ("LAN"), Wide Area Network ("WAN"), the Internet, and the like. In a distributed computing environment, program modules or subroutines may be located in both local and remote memory storage devices. Distributed computing may be employed to load balance and/or aggregate resources for processing. Alternatively, aspects of the gaming platform 400 may be distributed electronically over the Internet or over other networks (including wireless networks).

Computer executable instructions and data may be stored in memory (e.g., registers, cache memory, random access memory, flash, etc.) which is accessible by the processor 401. These stored instruction codes (e.g., programs) may engage the processor components, motherboard, and/or other system components to perform desired operations.

The table tablet according to one embodiment allows casinos to customize the tabletop to administer different popular casino games. Additionally, casinos can also customize minor details such as game instruction, player position, artistic design, etc. Moreover, the table tablet 100 is able to display a virtual user's wagering decision during a LIVE table game.

Preferably, the system provides Virtual Reality (VR) to virtual players, simultaneously with LIVE games, because dealer is able to deal physical cards to virtual players. The camera 103 and tablet functionalities allow the dealer to properly deal cards to virtual players, and vice versa allowing virtual players to properly view the on-going game from first-person perspectives.

Generally, there are two types of structures relating to casino gaming table: a table accommodating a number of LIVE players ranging from 3 to 10 or a table accommodating a number of LIVE players 10 or more. The tablet table 100 according to the present disclosure is different and unique structurally because it accommodates an unrestricted number of player.

Figure 5:
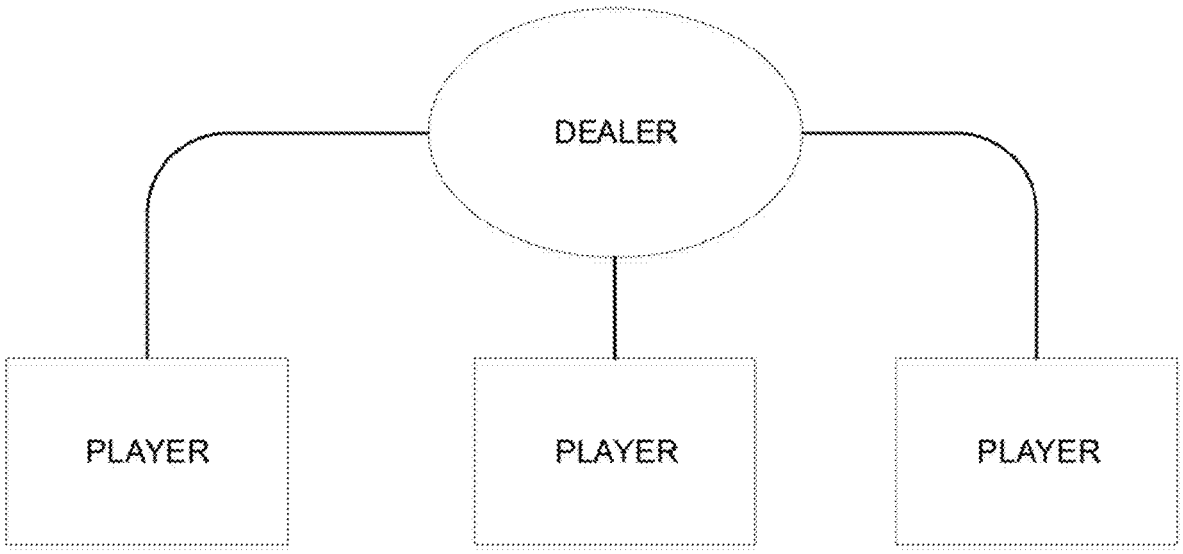
PRIOR ART FIGURE 5
FIG. 5 is a block diagram showing a traditional method of playing a table game among a small number of players.

Referring to FIG. 5, there is seen a block diagram showing a dealer and three players with a traditional method. 3 to 10: This range of player positions, mostly seen on traditional casino tables, is limited mostly due to the permanent design of these conventional tabletops. With limited space in design in terms of physical table's overall size and surface area of the tabletop, dealers' services are also limited to the capped number of player positions on the permanent tabletop.

Figure 6:
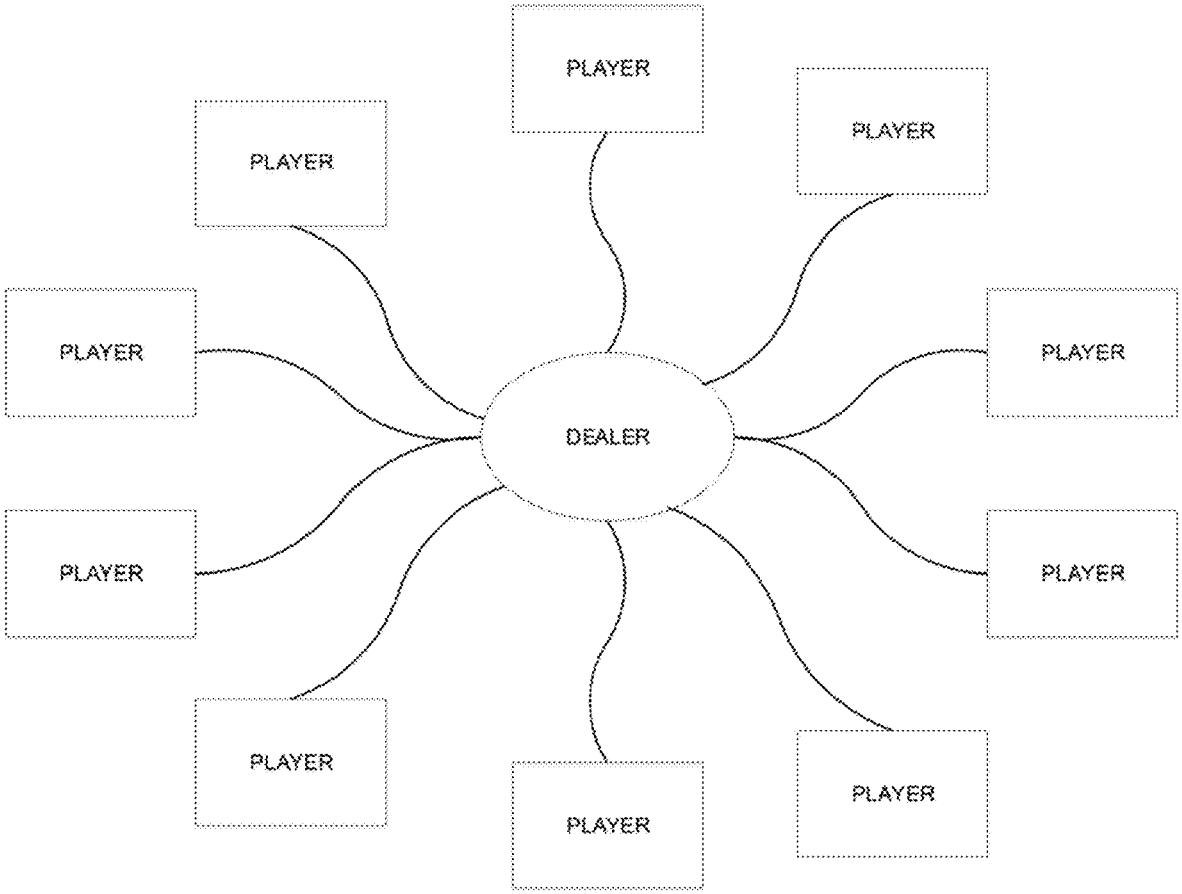
PRIOR ART FIGURE 6
FIG. 6 is a block diagram showing a traditional method of playing a table game among a large number of players.

Referring to FIG. 6, there is seen a block diagram showing a dealer(s) and ten or more players with a traditional method. This range of player positions, mostly seen on modern electronic table game options, is known as stadium-style structure. A dealer or multiple dealers can administer games to player positions ranging from 10 to hundreds as long as the physical casino floor can accommodate the table machines. This structure cuts labor cost immediately but doesn't necessary increase casino revenue, especially during slow seasons—this system assumes that casino foot traffic will always be consistent and predictable, which is far away from the reality.

Figure 7:
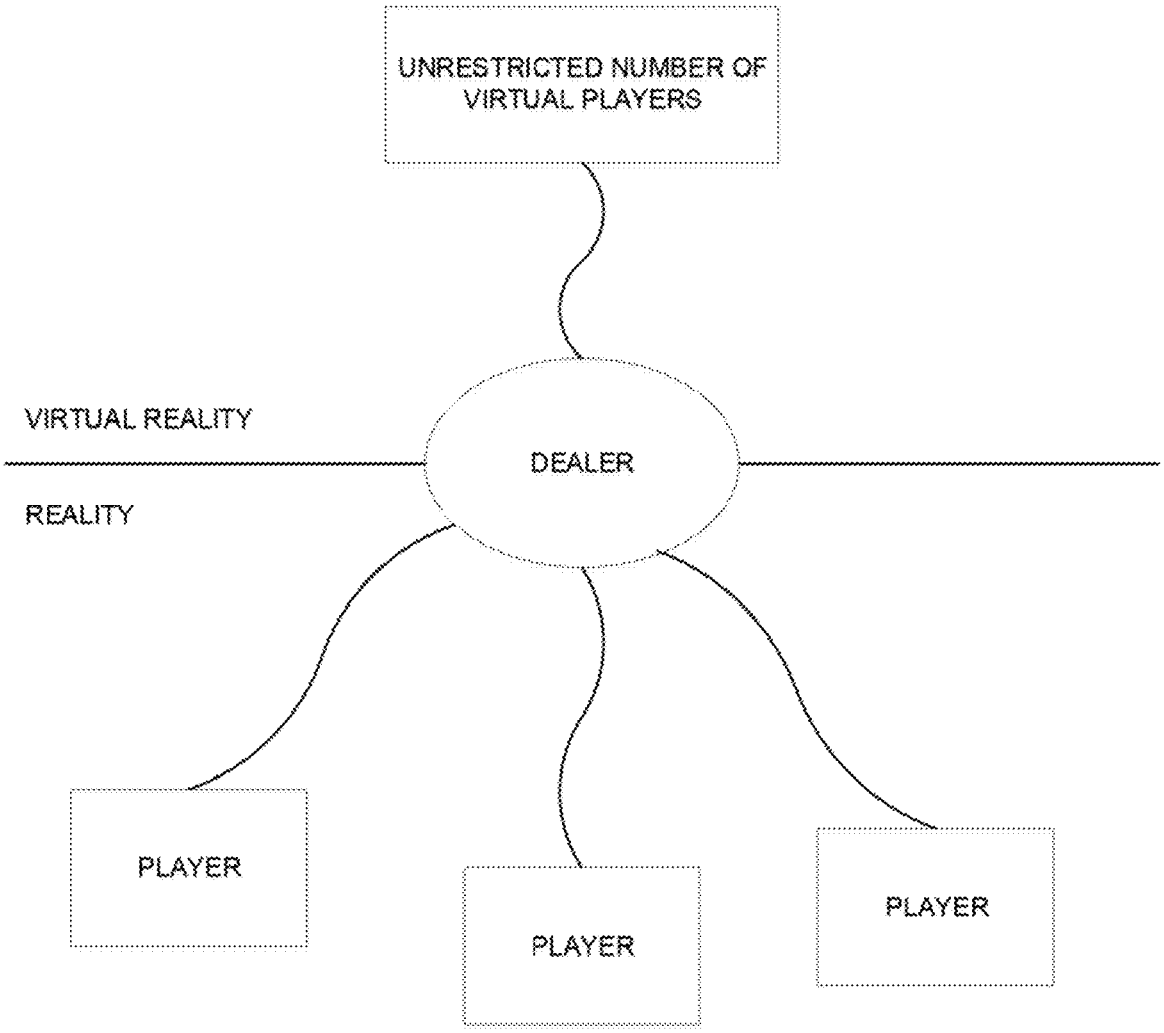
FIG. 7 is a block diagram showing an exemplary method of playing a table game according to one embodiment of the present disclosure.

Referring to FIG. 7, there is seen a block diagram showing a dealer, real players, and virtual players according to one embodiment of the present disclosure. Unrestricted: Depending on the casino game, the tablet table 100 is able to allow dealers to administer games to an unrestricted number of player positions because of its VR capabilities. This structure allows maximum player traffic minimizing dealers' idle time.

In one embodiment, the scanner 101, cameras 103, the display 105, and the chip tray camera 205 as shown in FIGS. 1 and 2 may be connected to a computer board in the tablet table 301. The computer board may have at least one processor and memory.

In one embodiment, the gaming platform 400 may further comprise an input output interfaces (I/O) that facilitate communication between user input devices, peripheral devices, co-processor devices, and/or the like and components of the gaming platform 400 using protocols such as those for handling audio, data, video interface, wireless transceivers, or the like (e.g., Bluetooth®, IEEE 1394a-b, serial, universal serial bus (USB), Digital Visual Interface (DVI), 802.11a/b/g/n/x, cellular, etc.).

In one embodiment, the components shown in FIGS. 1-4 may be connected via various wired and/or wireless connection protocols including, but not limited to, direct connect, Ethernet, IEEE 802.11a-x, miracast and the like. Some components of the system may include various protocols or comply with various standards or certifications set forth by different associations or regulatory agencies. For example, some embodiments may use the slot accounting system (SAS) protocol or comply with the game to system (G2S) standard.

The present invention or any part(s) or function(s) thereof, including, e.g., the tablet table 100, terminal device 305, 307, networks, 309, server 311, card scanner 101, camera 103, display 105, storage device 413, chip processing module 415, card processing module 417, display module 419, operating system 421, and/or database 423 may be implemented using hardware, software, or a combination thereof, and may be implemented in one or more computer systems or other processing systems. A computer system for performing the operations of the present invention and capable of carrying out the functionality described herein can include one or more processors connected to a communications infrastructure (e.g., a communications bus, a cross-over bar, or a network). Various software embodiments are described in terms of such an exemplary computer system. After reading this description, it will become apparent to a person skilled in the relevant art(s) how to implement the invention using other computer systems and/or architectures.

The computer system can include a display interface that forwards graphics, text, and other data from the communication infrastructure (or from a frame buffer) for display on a display unit. The display interface can communicate with a browser. The computer system also includes a main memory, preferably a random access memory, and may also include a secondary memory and a database. The secondary memory may include, for example, a hard disk drive and/or a removable storage drive, representing a floppy disk drive, a magnetic tape drive, an optical disk drive, etc. The removable storage drive reads from and/or writes to a removable storage unit in a well-known manner. The removable storage unit can represent a floppy disk, magnetic tape, optical disk, etc. which is read by and written to by the removable storage drive. As will be appreciated, the removable storage unit can include a computer usable storage medium having stored therein computer software and/or data.

The computer system may also include a communications interface which allows software and data to be transferred between the computer system and external devices. The terms "computer program medium" and "computer usable medium" are used to refer generally to media such as the removable storage drive, a hard disk installed in the hard disk drive, and signals. The invention can be implemented on those. These computer program products provide software to the computer system.

Computer programs or control logic are stored in the main memory and/or the secondary memory. Computer programs may also be received via the communications interface. Such computer programs or control logic (software), when executed, cause the computer system or its processor to perform the features and functions of the present invention, as discussed herein.

While the invention has been particularly shown and described with respect to preferred embodiment(s) thereof, it should be understood that the embodiment(s) have been presented by way of example, and not limitation. It will be apparent to persons skilled in the relevant art(s) that various changes in form and detail can be made therein without departing from the spirit and scope of the present invention. Thus, the present invention should not be limited by any above-described exemplary embodiment.

What is claimed is:

1. A multi-player gaming system for operating a game involving a live dealer, at least one live player and at least one virtual player, the multi-player gaming system comprising:

a tablet table, the tablet table comprising:
- a display;
- an arm rest surrounding the display;
- at least one camera placed on the arm rest at each of a plurality of player seating areas of the tablet table;
- a chip tray placed in front of a dealer seating area of the tablet table;
- a chip tray camera placed on a side of the chip tray, wherein the chip tray camera captures an image of chips placed in the chip tray;
- a card scanner in front of the dealer seating area of the tablet table;
- at least one processor;
- a memory; and
- at least one program; wherein the at least one camera captures images at a height of the at least one virtual player at a corresponding one of the plurality of player seating areas-near the table, the at least one camera comprises an omnidirectional camera, the at least one camera comprises an infrared camera for detecting body heat of the at least one live player seating near the infrared camera, and the at least one program is stored in the memory and is executed by the at least one processor, the at least one program comprising instructions for:
- capturing by the at least one camera at least one chip placed in a chip area of the at least one live player on the tablet table;
- determining a number and a value of the at least one chip;
- displaying the value of the at least one chip in the chip area of the at least one live player on a terminal device of the at least one virtual player;
- capturing by the at least one camera at least one card of the at least one live player placed on a card area of the at least one live player on the tablet table;
- isolating the at least one card of the at least one live player into one or more individual cards;
- extracting and determining a rank of the one or more individual cards; and
- extracting and determining a suit of the one or more individual cards.

* * * * *